US011162732B2

(12) United States Patent
James

(10) Patent No.: US 11,162,732 B2
(45) Date of Patent: Nov. 2, 2021

(54) QUENCH SYSTEM FOR A REFRIGERATION CYCLE OF A LIQUEFIED NATURAL GAS FACILITY AND METHOD OF QUENCHING

(71) Applicant: CONOCOPHILLIPS COMPANY, Houston, TX (US)

(72) Inventor: Will T. James, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 621 days.

(21) Appl. No.: 15/092,866

(22) Filed: Apr. 7, 2016

(65) Prior Publication Data

US 2016/0298899 A1 Oct. 13, 2016

Related U.S. Application Data

(60) Provisional application No. 62/144,100, filed on Apr. 7, 2015.

(51) Int. Cl.

| | |
|---|---|
| ***F25J 1/00*** | (2006.01) |
| ***F25J 1/02*** | (2006.01) |
| ***F25B 1/10*** | (2006.01) |

(52) U.S. Cl.

CPC ..... *F25J 1/0022* (2013.01); *F25B 1/10* (2013.01); *F25J 1/004* (2013.01); *F25J 1/0052* (2013.01);

(Continued)

(58) Field of Classification Search

CPC ..... F25J 1/004; F25J 1/0052; F25J 1/0085; F25J 1/0087; F25J 1/0279; F25J 1/0298; F25J 1/0022; C21D 1/62

See application file for complete search history.

(56) References Cited

U.S. PATENT DOCUMENTS

| | | | |
|---|---|---|---|
| 3,092,976 | A | 6/1963 | Hashemi-Tafreshi |
| 3,315,477 | A | 4/1967 | Carr |

(Continued)

FOREIGN PATENT DOCUMENTS

| | | | |
|---|---|---|---|
| EP | 0131947 | B1 | 11/1988 |
| WO | 2013177433 | A2 | 11/2013 |
| WO | 2014204601 | | 12/2014 |

OTHER PUBLICATIONS

International Search Report for parent case, App. No. PCT/US2016/026401, dated Jun. 20, 2016.

(Continued)

*Primary Examiner* — Frantz F Jules
*Assistant Examiner* — Webeshet Mengesha
(74) *Attorney, Agent, or Firm* — Polsinelli PC

(57) ABSTRACT

A quench system for a refrigeration cycle of a liquefied natural gas (LNG) facility includes at least one compressor for compressing a refrigerant that cools a natural gas stream. Also included is a quench fluid supply structure containing a quench fluid. Further included is a cooler vessel and a quench fluid line extending from the quench fluid supply structure and through the cooler vessel for cooling therein, the quench fluid maintained in a liquid state through the entirety of the quench fluid line. Yet further included is a quench control valve disposed downstream of the cooler vessel to control a flow rate of the quench fluid routed therein. Also included is a refrigerant suction drum located downstream of the quench control valve and configured to receive the quench fluid from the quench fluid line, the refrigerant suction drum in fluid communication with at least one component for cooling.

19 Claims, 3 Drawing Sheets

(52) U.S. Cl.
CPC ..... *F25J 1/0085* (2013.01); *F25J 1/0087* (2013.01); *F25J 1/021* (2013.01); *F25J 1/0279* (2013.01); *F25J 1/0298* (2013.01); *F25B 2400/12* (2013.01)

(56) References Cited

U.S. PATENT DOCUMENTS

| | | | | |
|---|---|---|---|---|
| 4,254,637 | A * | 3/1981 | Brauch | F25B 43/02 62/468 |
| 4,275,570 | A * | 6/1981 | Szymaszek | F25B 43/02 62/468 |
| 4,828,591 | A * | 5/1989 | Yan | F25J 1/0022 62/613 |
| 5,651,270 | A * | 7/1997 | Low | F25J 1/0022 62/613 |
| 8,671,699 | B2 | 3/2014 | Rpsetta et al. | |
| 2011/0185767 | A1* | 8/2011 | Jager | F25J 1/0022 62/614 |
| 2014/0308148 | A1* | 10/2014 | Takeda | F04C 15/0092 418/84 |
| 2015/0050125 | A1* | 2/2015 | Simon-Delgado | F16J 15/162 415/110 |

OTHER PUBLICATIONS

Ross, Stephen L., and Raymond F. Beckinger. "Compressor seal selection and justification." In Proceedings of the Thirty-second Turbomachinery Symposium, Turbomachinery Laboratory, Texas A&M University, College Station, Texas, pp. 167-177. 2003.

* cited by examiner

QUENCH SYSTEM FOR A REFRIGERATION CYCLE OF A LIQUEFIED NATURAL GAS FACILITY AND METHOD OF QUENCHING

PRIORITY CLAIM

This application is a non-provisional application which claims benefit under 35 USC § 119(e) to U.S. Provisional Application Ser. No. 62/144,100 filed Apr. 7, 2015, entitled "QUENCH SYSTEM FOR A REFRIGERATION CYCLE OF A LIQUEFIED NATURAL GAS FACILITY AND METHOD OF QUENCHING," which is incorporated herein in its entirety.

FIELD OF THE INVENTION

This invention relates to liquefied natural gas (LNG) facilities and, more particularly, to a quench system for a refrigeration cycle of a LNG facility, as well as a method of quenching.

BACKGROUND OF THE INVENTION

Cryogenic liquefaction is commonly used to convert natural gas into a more convenient form for transportation and/or storage. Because liquefying natural gas greatly reduces its specific volume, large quantities of natural gas can be economically transported and/or stored in liquefied form. Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers. Storing natural gas in its liquefied form can help balance periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Systems and processes associated with LNG facilities generally incorporate a propane quench scheme into the propane refrigerant system. The propane quench scheme is provided to protect propane refrigerant compressors and their associated mechanical seal materials from high temperatures that develop during continuous recycle operation. Such schemes attempt to avoid routing two-phase quench fluid to quench injection nozzles of the quench system. Two-phase flow to the injection nozzles results in instability of the quench system and the need for greater operator intervention to ensure that adequate quench rates are maintained when they are required. Two-phase flow to the nozzles also contributes to the risk of damage to the propane refrigerant compressors and mechanical seals due to the instability in imparts on the control scheme requiring the quench controls to be operated in manual mode during certain operating conditions. This removes the capability of the control scheme to respond to any changes in conditions in an automatic fashion, requiring the human operator to do so, thus increasing the risk of damage to the machines due to human error through an incorrect action or through not being able to respond in adequate time to rapidly changing conditions.

SUMMARY OF THE INVENTION

According to one embodiment of the invention, a quench system for a refrigeration cycle of a liquefied natural gas (LNG) facility is provided. The quench system includes at least one compressor for compressing a refrigerant that cools a natural gas stream. The quench system also includes a quench fluid supply structure containing a quench fluid. The quench system further includes a cooler vessel. The quench system yet further includes a quench fluid line extending from the quench fluid supply structure and through the cooler vessel for cooling therein, the quench fluid maintained in a liquid state through the entirety of the quench fluid line. The quench system also includes a quench control valve disposed downstream of the cooler vessel along the quench fluid line to control a flow rate of the quench fluid routed therein. The quench system further includes a refrigerant suction drum located downstream of the quench control valve and configured to receive the quench fluid from the quench fluid line, the refrigerant suction drum in fluid communication with at least one component of the compressor for cooling the at least one component.

According to another embodiment of the invention, a method of quenching a compressor of a refrigeration cycle in a liquefied natural gas (LNG) facility is provided. The method includes routing a quench fluid from a quench supply structure along a quench fluid line. The method also includes cooling the quench fluid in a cooler vessel. The method further includes controlling a flow rate of the quench fluid with a quench control valve disposed downstream of the cooler vessel along the quench control valve. The method yet further includes routing the quench fluid to a refrigerant suction drum in fluid communication with at least one component of the compressor for cooling the at least one component with the quench fluid, wherein the quench fluid is maintained in a liquid state along an entire length of the quench fluid line.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

The present invention can be implemented in a facility used to cool natural gas to its liquefaction temperature to thereby produce liquefied natural gas (LNG). The LNG facility generally employs one or more refrigerants to extract heat from the natural gas and reject to the environment. Numerous configurations of cascade LNG systems exist and the present invention may be implemented in many different types of cascade LNG systems.

In one embodiment, the present invention is implemented in a cascade LNG system employing a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade LNG system can employ one or more expansion cooling stages to simultaneously cool the LNG while reducing its pressure.

The embodiments illustrated and described below refer to systems and processes that include a heavies removal unit or zone. However, it is to be appreciated that there are many instances where a heavies removal unit or zone is not present.

Figure 1:
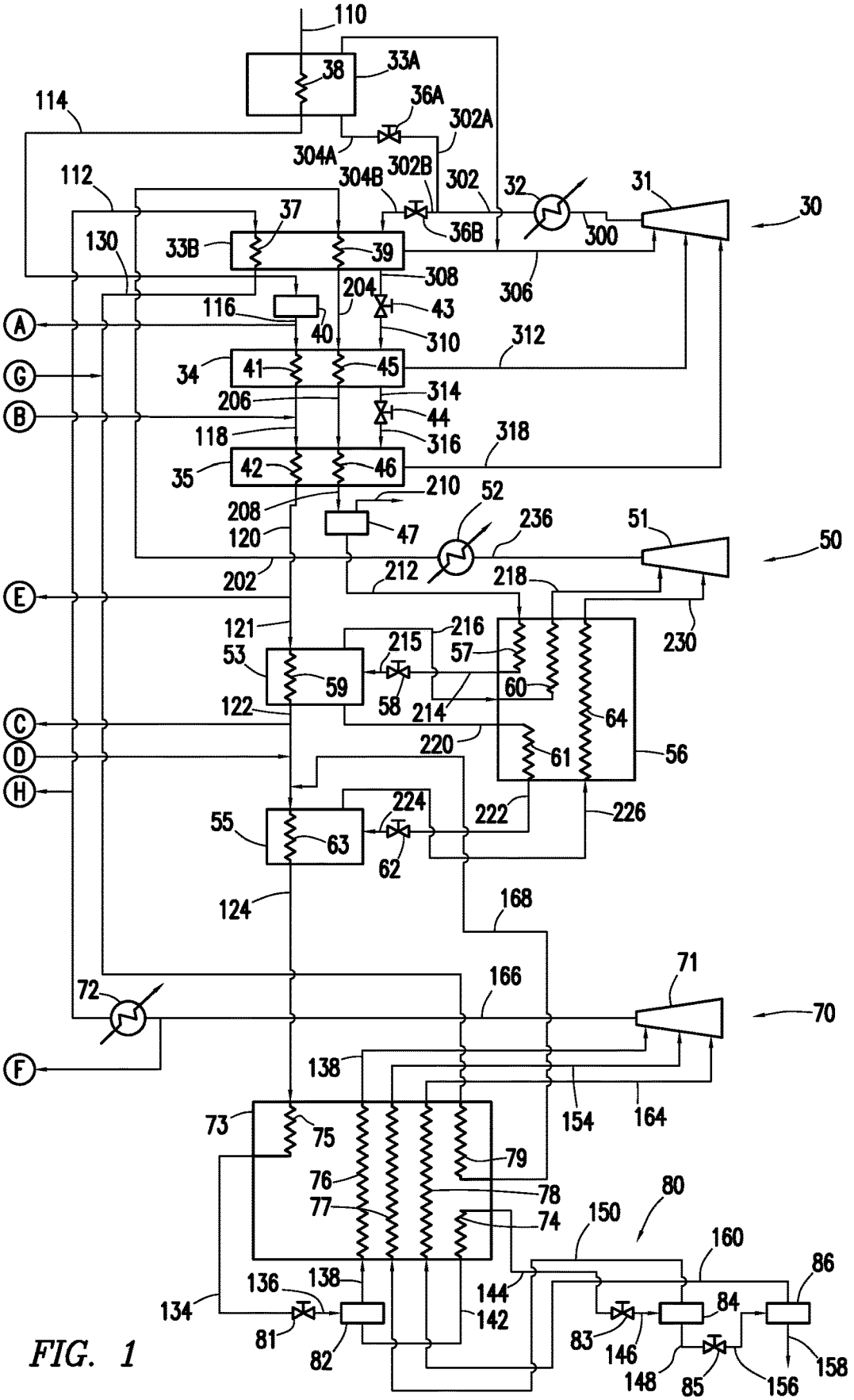
FIG. 1 is a schematic illustration of a cascade-type LNG facility configured in accordance with one embodiment of the invention.

Referring now to FIG. 1, one embodiment of a cascade-type LNG facility in accordance with one embodiment of the present invention is illustrated. The LNG facility depicted in FIG. 1 generally comprises a propane refrigeration cycle 30, an ethylene refrigeration cycle 50, and a methane refrigeration cycle 70 with an expansion section 80. While "propane," "ethylene," and "methane" are used to refer to respective first, second, and third refrigerants, it should be understood that the embodiment illustrated in FIG. 1 and described herein can apply to any combination of suitable refrigerants. The main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a first high-stage methane expansion valve and/or expander 81, a first high-stage methane flash drum 82, a second high-stage methane expansion valve and/or expander 87, a second high-stage methane flash drum 88, an intermediate-stage methane expansion valve and/or expander 83, an intermediate-stage methane flash drum 84, a low-stage methane expansion valve and/or expander 85, and a low-stage methane flash drum 86.

The operation of the LNG facility illustrated in FIG. 1 will now be described in more detail, beginning with propane refrigeration cycle 30. Propane is compressed in multi-stage (e.g., three-stage) propane compressor 31 driven by, for example, a gas turbine driver (not illustrated). The stages of compression may exist in a single unit or two or more separate units mechanically coupled to a single driver. Upon compression, the propane is passed through conduit 300 to propane cooler 32, wherein it is cooled and condensed through indirect heat exchange with an external fluid (e.g., air or water). The stream from propane cooler 32 can then be passed through conduits 302A and 302B to pressure reduction means, illustrated as expansion valves 36A and 36B, wherein the pressure of the liquefied propane is reduced, thereby evaporating or flashing a portion thereof. The resulting two-phase streams then flow through conduits 304A and 304B into high-stage propane chillers 33A and 33B. High stage propane chiller 33A uses the flashed propane refrigerant to cool the incoming natural gas stream in conduit 110. High stage propane chiller 33B uses the flashed propane refrigerant to cool the predominantly methane refrigerant stream in conduit 112.

The cooled natural gas stream from high-stage propane chiller 33A flows through conduit 114 to a separation vessel, wherein water and in some cases propane and heavier components are removed, typically followed by a treatment system 40, in cases where not already completed in upstream processing, wherein moisture, mercury and mercury compounds, particulates, and other contaminants are removed to create a treated stream. The stream exits the treatment system 40 through conduit 116. The stream can then enter intermediate-stage propane chiller 34, wherein the stream is cooled in indirect heat exchange means 41 through indirect heat exchange with a yet-to-be-discussed propane refrigerant stream. The resulting cooled stream in conduit 118 is then routed to low-stage propane chiller 35, wherein the stream can be further cooled through indirect heat exchange means 42. The resultant cooled stream can then exit low-stage propane chiller 35 through conduit 120. Subsequently, the cooled stream in conduit 120 can be routed to high-stage ethylene chiller 53, which will be discussed in more detail shortly.

The combined vaporized propane refrigerant stream exiting high-stage propane chillers 33A and 33B is returned to the high-stage inlet port of propane compressor 31 through conduit 306. The liquid propane refrigerant in high-stage propane chiller 33A provides refrigeration duty for the natural gas stream 110. The liquefied portion of the propane refrigerant exits high-stage propane chiller 33B through conduit 308 and is passed through a pressure-reduction means, illustrated here as expansion valve 43, whereupon the pressure of the liquefied propane refrigerant is reduced to thereby flash or vaporize a portion thereof. The resulting two-phase refrigerant stream can enter the intermediate-stage propane chiller 34 through conduit 310, thereby providing coolant for the natural gas stream (in conduit 116) and to yet-to-be-discussed streams entering intermediate-stage propane chiller 34 through conduits 115 and 204. The vaporized portion of the propane refrigerant exits intermediate-stage propane chiller 34 through conduit 312 and can then enter the intermediate-stage inlet port of propane compressor 31. The liquefied portion of the propane refrigerant exits intermediate-stage propane chiller 34 through conduit 314 and is passed through a pressure-reduction means, illustrated here as expansion valve 44, whereupon the pressure of the liquefied propane refrigerant is reduced to thereby flash or vaporize a portion thereof. The resulting vapor-liquid refrigerant stream can then be routed to low-stage propane chiller 35 through conduit 316 and where the refrigerant stream can cool the natural gas stream (in conduit 118) and yet-to-be-discussed streams entering low-stage propane chiller 35 through conduits 117 and 206, respectively. The vaporized propane refrigerant stream then exits low-stage propane chiller 35 and is routed to the low-stage inlet port of propane compressor 31 through conduit 318 wherein it is compressed and recycled as previously described.

As shown in FIG. 1, a stream of ethylene refrigerant in conduit 202 enters high-stage propane chiller 33B, wherein the ethylene stream is cooled through indirect heat exchange means 39. The resulting cooled ethylene stream can then be routed in conduit 204 from high-stage propane chiller 33B to intermediate-stage propane chiller 34. Upon entering intermediate-stage propane chiller 34, the ethylene refrigerant stream can be further cooled through indirect heat exchange means 45 in intermediate-stage propane chiller 34. The resulting cooled ethylene stream can then exit intermediate-stage propane chiller 34 and can be routed through conduit 206 to enter low-stage propane chiller 35. In low-stage propane chiller 35, the ethylene refrigerant stream can be at least partially condensed, or condensed in its entirety, through indirect heat exchange means 46. The resulting stream exits low-stage propane chiller 35 through conduit 208 and can subsequently be routed to a separation vessel 47, wherein a vapor portion of the stream, if present, can be removed through conduit 210, while a liquid portion of the ethylene refrigerant stream can exit separator 47 through conduit 212. The liquid portion of the ethylene refrigerant stream exiting separator 47 can have a representative temperature and pressure of about −24° F. (about −31° C.) and about 285 psia (about 1,965 kPa).

Turning now to ethylene refrigeration cycle 50 in FIG. 1, the liquefied ethylene refrigerant stream in conduit 212 can enter ethylene economizer 56, wherein the stream can be further cooled by an indirect heat exchange means 57. The resulting cooled liquid ethylene stream in conduit 214 can then be routed through a pressure reduction means, illustrated here as expansion valve 58, whereupon the pressure of the cooled predominantly liquid ethylene stream is reduced to thereby flash or vaporize a portion thereof. The cooled, two-phase stream in conduit 215 can then enter high-stage ethylene chiller 53. In high-stage ethylene chiller 53, at least a portion of the ethylene refrigerant stream can vaporize to further cool the stream in conduit 121 by an indirect heat exchange means 59. The vaporized and remaining liquefied ethylene refrigerant exits high-stage ethylene chiller 53 through respective conduits 216 and 220. The vaporized ethylene refrigerant in conduit 216 can re-enter ethylene economizer 56, wherein the stream can be warmed through an indirect heat exchange means 60 prior to entering the high-stage inlet port of ethylene compressor 51 through conduit 218, as shown in FIG. 1. The cooled stream in conduit 120 exiting low-stage propane chiller 35 can thereafter be split into two portions.

At least a portion of the natural gas stream can be routed through conduit E to a heavies removal unit (HRU). The remaining portion of the cooled natural gas stream in conduit 121 can be routed to high-stage ethylene chiller 53, and then can be cooled in indirect heat exchange means 59 of high-stage ethylene chiller 53.

The remaining liquefied ethylene refrigerant exiting high-stage ethylene chiller 53 in conduit 220 can re-enter ethylene economizer 56, to be further sub-cooled by an indirect heat exchange means 61. The resulting sub-cooled refrigerant stream exits ethylene economizer 56 through conduit 222 and can subsequently be routed to a pressure reduction means, illustrated here as expansion valve 62, whereupon the pressure of the refrigerant stream is reduced to thereby vaporize or flash a portion thereof. The resulting, cooled two-phase stream in conduit 224 enters low-stage ethylene chiller/condenser 55.

A portion of the cooled natural gas stream exiting high-stage ethylene chiller 53 can be routed through conduit C to the heavies removal unit, while another portion of the cooled natural gas stream exiting high-stage ethylene chiller/condenser 53 can be routed through conduit 122 to enter indirect heat exchange means 63 of low-stage ethylene chiller/condenser 55. The remaining portion of the cooled natural gas stream in conduit 122 can then be combined with the vapor stream exiting the heavies removal unit in conduit D (i.e., HRU return stream).

In low-stage ethylene chiller/condenser 55, the cooled natural gas stream can be at least partially condensed through indirect heat exchange with the ethylene refrigerant entering low-stage ethylene chiller/condenser 55 through conduit 224. The vaporized ethylene refrigerant exits low-stage ethylene chiller/condenser 55 through conduit 226 and then enters ethylene economizer 56. In ethylene economizer 56, the vaporized ethylene refrigerant stream can be warmed through an indirect heat exchange means 64 prior to being fed into the low-stage inlet port of ethylene compressor 51 through conduit 230. As shown in FIG. 1, a stream of compressed ethylene refrigerant exits ethylene compressor 51 through conduit 236 and can subsequently be routed to ethylene cooler 52, wherein the compressed ethylene stream can be cooled through indirect heat exchange with an external fluid (e.g., water or air). The resulting cooled ethylene stream can then be introduced through conduit 202 into high-stage propane chiller 33B for additional cooling as previously described.

The cooled natural gas stream exiting low-stage ethylene chiller/condenser 55 in conduit 124 can also be referred to as the "pressurized LNG-bearing stream." As shown in FIG. 1, the pressurized LNG-bearing stream exits low-stage ethylene chiller/condenser 55 through conduit 124 prior to entering methane economizer 73. In methane economizer 73, the pressurized LNG-bearing stream in conduit 124 can be cooled in an indirect heat exchange means 75 through indirect heat exchange with one or more yet-to-be discussed methane refrigerant streams. The cooled, pressurized LNG-bearing stream exits the methane economizer 73 through conduit 134 and can then be routed into expansion section 80 of methane refrigeration cycle 70. In expansion section 80, the pressurized LNG-bearing stream first passes through first high-stage methane expansion valve 81 and/or expander, whereupon the pressure of this stream is reduced to thereby vaporize or flash a portion thereof. The resulting two-phase methane-rich stream in conduit 136 can then enter high-stage methane flash drum 82, whereupon the vapor and liquid portions of the reduced-pressure stream can be separated. The vapor portion of the reduced-pressure stream (also called the high-stage flash gas) exits high-stage methane flash drum 82 through conduit 138 to then enter methane economizer 73, wherein the high-stage flash gas can be heated through indirect heat exchange means 76 of methane economizer 73. The resulting warmed vapor stream exits main methane economizer 73 through conduit 140 and can then be routed to the high-stage inlet port of methane compressor 71.

The liquid portion of the reduced-pressure stream exits high-stage methane flash drum 82 through conduit 142A to then re-enter methane economizer 73, wherein the liquid stream can be cooled through indirect heat exchange means 74 of methane economizer 73. The resulting cooled stream exits main methane economizer 73 through conduit 144 and can then be routed to a second expansion stage, illustrated here as intermediate-stage expansion valve 83 but could include an expander. Intermediate-stage expansion valve 83 further reduces the pressure of the cooled stream which reduces the stream's temperature by vaporizing or flashing a portion thereof. The stream in conduit 146 can then enter intermediate-stage methane flash drum 84, wherein the liquid and vapor portions of this stream can be separated and can exit the intermediate-stage flash drum 84 through respective conduits 148 and 150. The vapor portion (also called the intermediate-stage flash gas) in conduit 150 can re-enter methane economizer 73, wherein the vapor portion can be heated through an indirect heat exchange means 77 of main methane economizer 73. The resulting warmed stream can then be routed through conduit 154 to the intermediate-stage inlet port of methane compressor 71.

The liquid stream exiting intermediate-stage methane flash drum 84 through conduit 148 can then pass through a low-stage expansion valve 85 and/or expander, whereupon the pressure of the liquefied stream can be further reduced to thereby vaporize or flash a portion thereof. The resulting cooled, stream in conduit 156 can then enter low-stage methane flash drum 86, wherein the vapor and liquid phases can be separated. The liquid stream exiting low-stage methane flash drum 86 through conduit 158 can comprise the liquefied natural gas (LNG) product. The LNG product, which is at about atmospheric pressure, can be routed through conduit 158 downstream for subsequent storage, transportation, and/or use.

The vapor stream exiting low-stage methane flash drum (also called the low-stage methane flash gas) in conduit 160 can be routed to methane economizer 73, wherein the low-stage methane flash gas can be warmed through an indirect heat exchange means 78 of main methane economizer 73. The resulting stream can exit methane economizer 73 through conduit 164, whereafter the stream can be routed to the low-stage inlet port of methane compressor 71.

Methane compressor 71 can comprise one or more compression stages. In one embodiment, methane compressor 71 comprises three compression stages in a single module. In another embodiment, one or more of the compression modules can be separate, but can be mechanically coupled to a common driver. Generally, one or more intercoolers (not shown) can be provided between subsequent compression stages.

As shown in FIG. 1, a compressed methane refrigerant stream exiting methane compressor 71 can be discharged into conduit 166 and routed to methane cooler 72, whereafter the stream can be cooled through indirect heat exchange with an external fluid (e.g., air or water) in methane cooler 72. The resulting cooled methane refrigerant stream exits methane cooler 72 through conduit 112, whereafter a portion of the methane refrigerant can be routed through conduit 431 as a fuel gas balance line to supplement fuel gas flow in conduit 410, while the remaining portion of the methane refrigerant stream can be optionally directed to and further cooled in propane refrigeration cycle 30.

In particular, the methane refrigerant stream may be directed to the propane refrigeration cycle 30 along conduit 112 and cooled through heat exchanger means 37 of the high stage propane chiller 33B, heat exchanger means 48 of the intermediate-stage propane chiller 34, and heat exchanger means 49 of the low-stage propane chiller 35. Alternatively, all or a portion of the methane refrigerant stream may bypass the propane refrigeration cycle 30 through conduit 113. Irrespective of whether the methane refrigerant stream is routed through the propane refrigeration cycle 30 or not, the stream is subsequently routed to main methane economizer 73, wherein the stream can be further cooled through indirect heat exchange means 79. The resulting sub-cooled stream exits main methane economizer 73 through conduit 168.

In the low-stage ethylene chiller/condenser 55, cooled stream 122 (which can include stream in conduit 122 and optionally streams in conduits D and 168) can be at least partially condensed and, often, subcooled through indirect heat exchange with the ethylene refrigerant entering low-stage ethylene chiller/condenser 55 through conduit 224. The vaporized ethylene refrigerant exits low-stage ethylene chiller/condenser 55 through conduit 226, which then enters ethylene economizer 56. In the ethylene economizer 56, vaporized ethylene refrigerant stream 226 can be warmed through an indirect heat exchange means 64 prior to being fed into the low-stage inlet port of ethylene compressor 51 through conduit 230. As shown in FIG. 1, a stream of compressed ethylene refrigerant exits ethylene compressor 51 through conduit 236 and subsequently enters ethylene cooler 52, wherein the compressed ethylene stream can be cooled through indirect heat exchange with an external fluid (e.g., water or air). The resulting cooled ethylene stream is introduced through conduit 202 into high-stage propane chiller 33B for additional cooling as previously described.

The condensed and, often, subcooled liquid natural gas stream exiting low-stage ethylene chiller/condenser 55 in conduit 124 can also be referred to as a "pressurized LNG-bearing stream." This pressurized LNG-bearing stream exits low-stage ethylene chiller/condenser 55 through conduit 124 prior to entering main methane economizer 73. In the main methane economizer 73, methane-rich stream in conduit 124 can be further cooled in an indirect heat exchange means 75 through indirect heat exchange with one or more methane refrigerant streams (e.g., 76, 77, 78). The cooled, pressurized LNG-bearing stream exits main methane economizer 73 through conduit 134 and routes to expansion section 80 of methane refrigeration cycle 70. In the expansion section 80, the pressurized LNG-bearing stream first passes through high-stage methane expansion valve or expander 81, whereupon the pressure of this stream is reduced to vaporize or flash a portion thereof. The resulting two-phase methane-rich stream in conduit 136 can then enter into high-stage methane flash drum 82, whereupon the vapor and liquid portions of the reduced-pressure stream can be separated. The vapor portion of the reduced-pressure stream (also called the high-stage flash gas) exits high-stage methane flash drum 82 through conduit 138 to then enter into main methane economizer 73, wherein at least a portion of the high-stage flash gas can be heated through indirect heat exchange means 76 of main methane economizer 73. The resulting warmed vapor stream exits main methane economizer 73 through conduit 138 and is then routed to the high-stage inlet port of methane compressor 71, as shown in FIG. 1.

The liquid portion of the reduced-pressure stream exits high-stage methane flash drum 82 through conduit 142 to then re-enter main methane economizer 73, wherein the liquid stream can be cooled through indirect heat exchange means 74 of main methane economizer 73. The resulting cooled stream exits main methane economizer 73 through conduit 144 and then routed to a second expansion stage, illustrated here as intermediate-stage expansion valve 83 and/or expander. Intermediate-stage expansion valve 83 further reduces the pressure of the cooled methane stream which reduces the stream's temperature by vaporizing or flashing a portion thereof. The resulting two-phase methane-rich stream in conduit 146 can then enter intermediate-stage methane flash drum 84, wherein the liquid and vapor portions of this stream can be separated and exits the intermediate-stage flash drum 84 through conduits 148 and 150, respectively. The vapor portion (also called the intermediate-stage flash gas) in conduit 150 can re-enter methane economizer 73, wherein the vapor portion can be heated through an indirect heat exchange means 77 of main methane economizer 73. The resulting warmed stream can then be routed through conduit 154 to the intermediate-stage inlet port of methane compressor 71, as shown in FIG. 1.

The liquid stream exiting intermediate-stage methane flash drum 84 through conduit 148 can then pass through a low-stage expansion valve 85 and/or expander, whereupon the pressure of the liquefied methane-rich stream can be further reduced to vaporize or flash a portion thereof. The resulting cooled, two-phase stream in conduit 156 can then enter low-stage methane flash drum 86, wherein the vapor and liquid phases are separated. The liquid stream exiting low-stage methane flash drum 86 through conduit 158 can comprise the liquefied natural gas (LNG) product at near atmospheric pressure. This LNG product can be routed downstream for subsequent storage, transportation, and/or use.

A vapor stream exiting low-stage methane flash drum (also called the low-stage methane flash gas) in conduit 160 can be routed to methane economizer 73, wherein the low-stage methane flash gas can be warmed through an indirect heat exchange means 78 of main methane economizer 73. The resulting stream can exit methane economizer 73 through conduit 164, whereafter the stream can be routed to the low-stage inlet port of methane compressor 71.

The methane compressor 71 can comprise one or more compression stages. In one embodiment, methane compressor 71 comprises three compression stages in a single module. In another embodiment, one or more of the compression modules can be separate but mechanically coupled to a common driver. Generally, one or more intercoolers (not shown) can be provided between subsequent compression stages.

As shown in FIG. 1, a compressed methane refrigerant stream exiting methane compressor 71 can be discharged into conduit 166. A portion of the compressed methane refrigerant stream exiting compressor 71 through conduit 166 can be routed through conduit F to for use as a fuel gas, while another portion of the compressed methane refrigerant can be routed to methane cooler 72, whereafter the stream can be cooled through indirect heat exchange with an external fluid (e.g., air or water) in methane cooler 72. The resulting cooled methane refrigerant stream exits methane cooler 72 through conduit 112, wherein a portion of the methane refrigerant can be routed through conduit H to a heavies removal system, while the remaining portion of the methane refrigerant stream can be directed to and further cooled in propane refrigeration cycle 30.

Upon cooling in the propane refrigeration cycle 30 through heat exchanger means 37, the methane refrigerant stream can be discharged into conduit 130 where it may be combined with methane-rich gas in conduit G from the mixed-reflux heavies removal system and subsequently routed to main methane economizer 73, wherein the stream can be further cooled through indirect heat exchange means 79. The resulting sub-cooled stream exits main methane economizer 73 through conduit 168 and then combined with stream in conduit 122 exiting high-stage ethylene chiller 53 and/or with stream in conduit D prior to entering low-stage ethylene chiller/condenser 55, as previously discussed.

The liquefaction process described herein may incorporate one of several types of cooling means including, but not limited to, (a) indirect heat exchange, (b) vaporization, and (c) expansion or pressure reduction. Indirect heat exchange, as used herein, refers to a process wherein a cooler stream cools the substance to be cooled without actual physical contact between the cooler stream and the substance to be cooled. Specific examples of indirect heat exchange means include heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Vaporization cooling refers to the cooling of a substance by evaporation or vaporization of a portion of the substance at a constant pressure. During vaporization, portion of the substance which evaporates absorbs heat from portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In some embodiments, expansion means may be a Joule-Thomson expansion valve. In other embodiments, the expansion means may be either a hydraulic or gas expander. Because expanders recover work energy from the expansion process, lower process stream temperatures are possible upon expansion.

Figure 2:
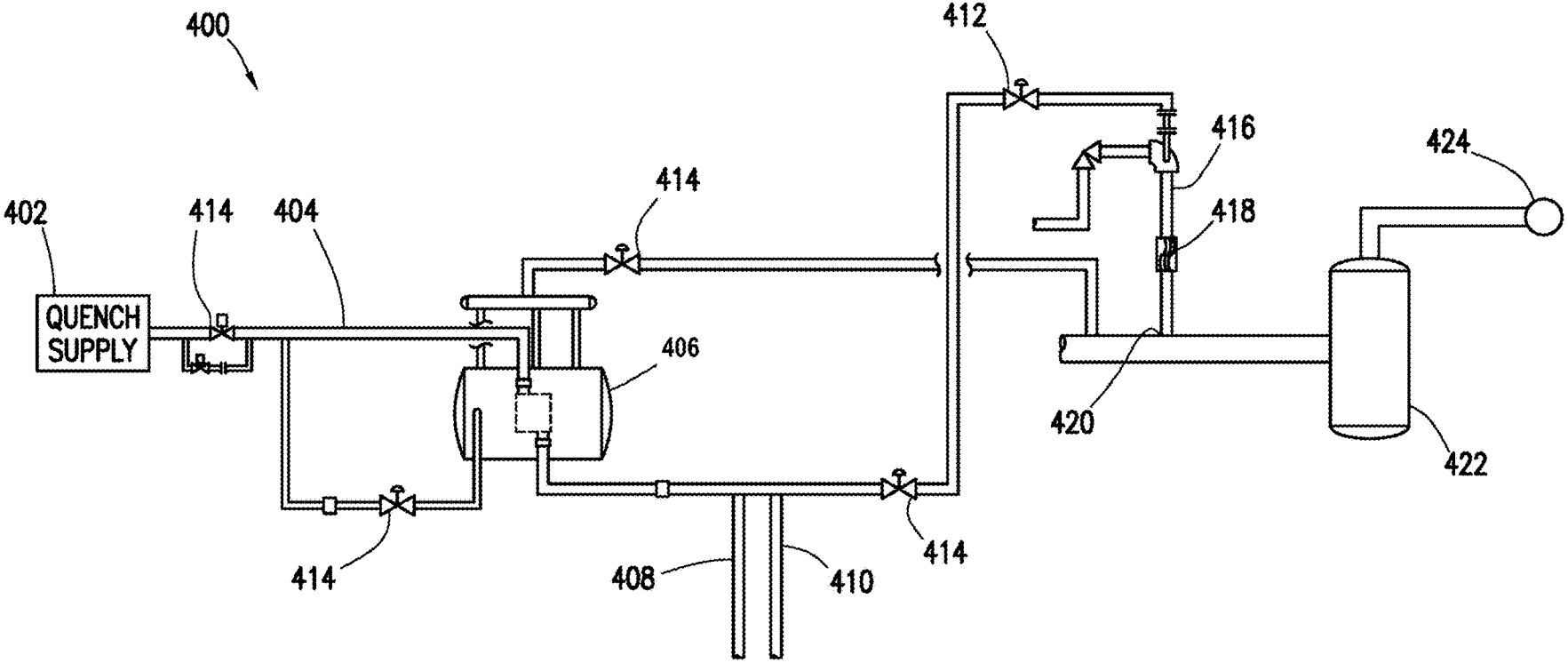
FIG. 2 is a schematic illustration of a quench system used in conjunction with a refrigeration cycle of the LNG facility, the quench system illustrated according to a first embodiment.
Figure 3:
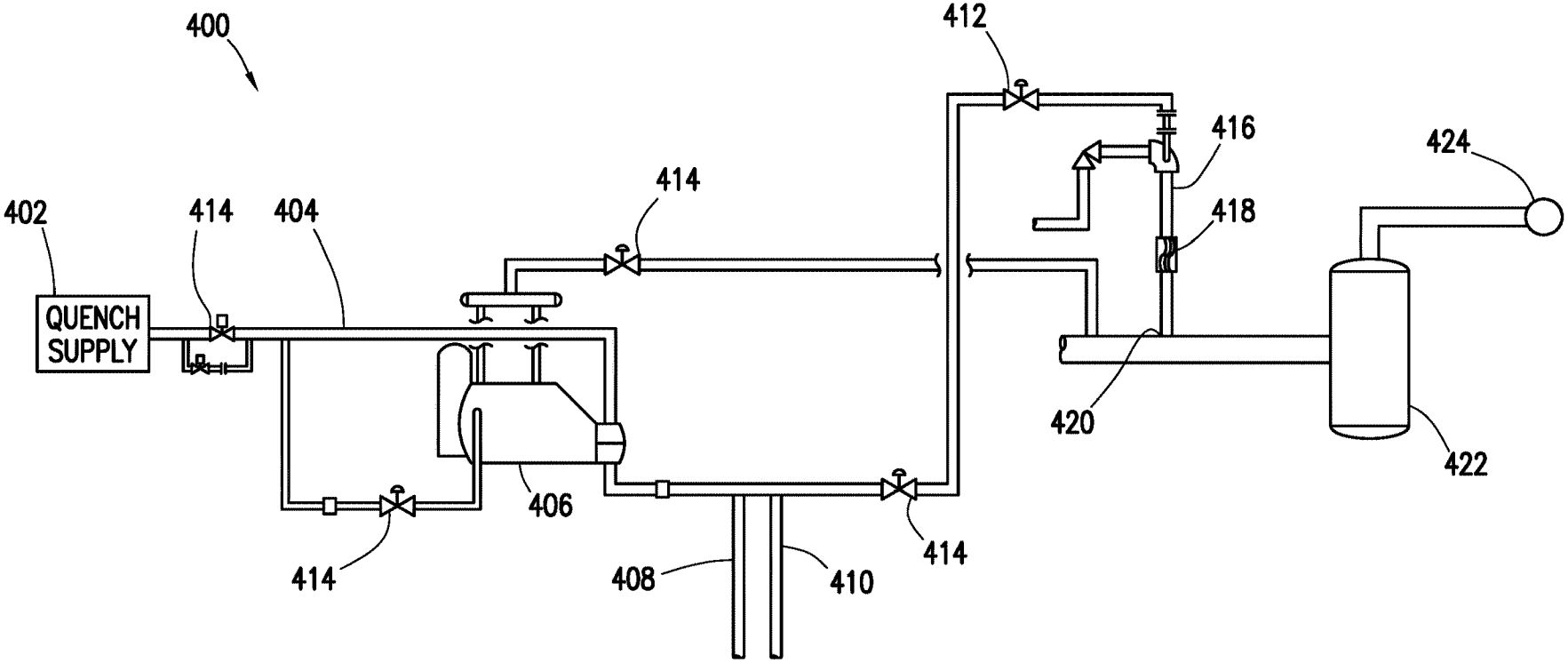
FIG. 3 is schematic illustration of the quench system according to a second embodiment.

Referring now to FIGS. 2 and 3, a quench system 400 is schematically illustrated. The quench system 400 is used in conjunction with the LNG facility described in detail above and illustrated in FIG. 1. More particularly, the quench system 400 is used directly with at least one of the above-described refrigeration cycles 30, 50 70 of the LNG facility. In an exemplary embodiment, the quench system 400 is fluidly coupled to one or more compressors 31 of the propane refrigeration cycle 30. In such an embodiment, the quench system 400 is provided to protect the propane refrigerant compressors and their associated mechanical seal materials from high temperatures that develop during continuous recycle operation in the closed-loop propane circuit. As will be appreciated from the description herein, the quench system 400 eliminates two-phase flow to the propane quench injection nozzles to avoid instability of the quench system and the need for greater operator intervention to ensure that adequate quench rates are maintained when they are required, particularly during transient conditions.

The quench system 400 includes a quench fluid supply structure 402, such as a propane accumulator, configured to contain and store a quench fluid, such as propane. The quench fluid and the refrigerant of the refrigeration cycle are the same fluid, thereby avoiding cross-contamination of either fluid in the event of a leak. The propane is routed along a quench fluid line 404 from the quench fluid supply structure 402 to a cooler vessel 406. The cooler vessel 406 may be a core-in-shell heat exchanger (FIG. 2) or a tube-in-kettle heat exchanger (FIG. 3).

Irrespective of the precise type of heat exchanger employed as the cooler vessel 406, the propane is cooled sufficiently therein to maintain the propane in a liquid state along an entire length of the quench fluid line 404, thereby avoiding the presence of two-phase quench fluid. As shown, the quench fluid line 404 branches off along lines 408 and 410 to route the cooled quench fluid to other stage quench circuits. For example, the illustrated portion of the quench system 400 is shown to provide quench fluid to a low stage compressor of the propane refrigeration cycle 30, while lines 408, 410 route quench fluid to intermediate and high stage compressors of the propane refrigeration cycle 30.

Subsequent to cooling in the cooler vessel 406, the propane is routed along the quench fluid line 404 to a quench control valve 412 disposed downstream of the cooler vessel 406. The quench control valve 412 is a flow management device that works in conjunction with additional valves 414 of the quench fluid line 404 to control the flow rate of the propane routed within the quench fluid line 404. Downstream of the quench control valve 412 is a vertical portion 416 of the quench fluid line 404 that includes a mixer 418 to manipulate the flow of the quench fluid. The quench fluid line 404 continues past the mixer 418 for a length of at least 10 times the diameter of the pipe of the quench fluid line 404 and terminates at a tie-in location 420 for routing of the propane to a propane suction drum 422. The distance of the line 404 from the tie-in location 420 to the propane suction drum 422 is at least 5 times the diameter of the pipe of the quench fluid line 404. As described above, the quench system 400 is typically employed to provide quench fluid to more than one compressor, such as various stage compressors of the propane refrigeration cycle 30.

The propane suction drum then feeds the propane to at least one, but typically a plurality of quench fluid injection nozzles 424. The quench fluid injection nozzles 424 inject the quench fluid into contact with at least one component of the compressor 31. The quench fluid is used to cool the at least one component of the compressor 31. The component may be a mechanical seal of the compressor, for example, but other components to be cooled are contemplated.

It is to be appreciated that numerous gages, controllers and signals are employed to provide a more automated quench system. The gages, controllers and signals are in communication with various portions and components of the quench system 400 to monitor and control various parameters of the system.

As described above, the quench system 400 advantageously maintains the quench fluid in a liquid state along the entire length of the quench fluid line, including up to the point of injection by the quench fluid injection nozzles 424, thereby avoiding potential undesirable effects of a two-phase quench fluid, as discussed above. Additionally, several advantages are achieved by employing a quench fluid that is the same as the refrigerant of the refrigeration cycle (e.g., propane). First, the system reduces the capital cost incurred to provide sub-cooling by avoiding integration with another process stream and the associated costs of additional plant plot space, piping, supports and other materials necessary to interconnect two separate systems installed in different locations within the plant. Second, complete elimination for the potential of cross-contamination between the two fluids is beneficially achieved. By eliminating cross-contamination, the loss of expensive propane refrigerant into the sub-cooling fluid and/or contamination of the propane system by the sub-cooling fluid is prevented. Contamination of the propane results in loss of production and the need for flaring of the flaring of the refrigerant in order to purge the system of the contaminants.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A quench system for a refrigeration cycle of a liquefied natural gas (LNG) facility, the quench system comprising:

at least one compressor operable to compress a refrigerant, the refrigerant operable to cool a natural gas stream;

a quench fluid supply structure operable to supply a quench fluid;

a cooler vessel operable to maintain the quench fluid in a liquid state;

a quench fluid line extending from the quench fluid supply structure and through the cooler vessel;

a quench control valve located downstream of the cooler vessel along the quench fluid line and in a flow direction of the quench fluid, the quench control valve operable to control a flow rate of the quench fluid; and a refrigerant suction drum located downstream of the quench control valve, the refrigerant suction drum operable to route the quench fluid to at least one component of the at least one compressor to cause the at least one component of the at least one compressor to be cooled, the refrigerant suction drum operable to receive the quench fluid from the quench control valve along a route extending between the quench control valve and the refrigerant suction drum, the route including at least one section having a diameter and a length defined by a multiple of the diameter.

2. The quench system of claim 1, wherein the refrigerant includes propane routed through a propane refrigerant cycle of the LNG facility and the quench fluid includes the propane.

3. The quench system of claim 1, wherein, the at least one compressor includes a plurality of compressors, and the plurality of compressors includes a high state propane suction drum, an intermediate stage propane suction drum, and a low stage propane suction drum.

4. The quench system of claim 1, wherein the cooler vessel is a tube-in-kettle heat exchanger.

5. The quench system of claim 1, wherein the cooler vessel is a core-in-shell heat exchanger.

6. The quench system of claim 1, wherein, the compressor includes a mechanical seal, and the refrigerant suction drum is in fluid communication with the mechanical seal with the mechanical seal operable to be cooled by the quench fluid.

7. The quench system of claim 1, wherein the quench fluid and the refrigerant are a same type of fluid.

8. The quench system of claim 1, further comprising:

a quench injection nozzle located downstream of the refrigerant suction drum, the quench injection nozzle operable to direct the quench fluid to the at least one component of the compressor and cause the at least one component of the compressor to be cooled.

9. The quench system of claim 1, wherein the quench fluid supply structure is a propane accumulator.

10. The quench system of claim 1, further comprising:

a mixer located downstream of the quench control valve along the quench fluid line and in the flow direction of the quench fluid, the mixer operable to manipulate the quench fluid.

11. The quench system of claim 1, wherein, the route extending between the between the quench control valve and the refrigerant suction drum includes the at least one section and another section, the at least one section is along the quench fluid line, the another section is from a tie-in location at an end of the quench fluid line and the refrigerant suction drum, and the another section has another diameter and another length defined by another multiple of the another diameter.

12. A method of quenching a compressor of a refrigeration cycle in a liquefied natural gas (LNG) facility, the method comprising:

supplying, via a quench fluid supply, a quench fluid to a quench fluid line;

maintaining, via a cooler vessel, the quench fluid in a liquid state along an entire length of the quench fluid line;

controlling, via a quench control valve, a flow rate of the quench fluid, the quench control valve located along the quench fluid line, downstream of the cooler vessel, and in a flow direction of the quench fluid and;

routing, via the quench fluid line, the quench fluid to a refrigerant suction drum along a route including at least one section having a diameter and a length defined by a multiple of the diameter; and cooling, via the quench fluid, at least one component of the compressor by routing the quench fluid from the refrigerant suction drum to the at least one component of the compressor.

13. The method of claim 12, further comprising:

manipulating, via a mixer, the quench fluid, the mixer located downstream of the quench control valve along the quench fluid line and in the flow direction of the quench fluid.

14. The method of claim 12, further comprising:

regulating, via at least one quench injection nozzle, a flow of the quench fluid between the refrigerant suction drum and the compressor.

15. The method of claim 12, further comprising:

routing the quench fluid to a plurality of compressors, the plurality of compressors including a high stage propane suction drum, an intermediate stage propane suction drum, and a low stage propane suction drum.

16. The method of claim 12, wherein the at least one component of the compressor is a mechanical seal.

17. A quench system for a refrigeration cycle of a liquefied natural gas (LNG) facility comprising:

at least one compressor operable to compress a refrigerant cooling a natural gas stream;

a quench fluid supply structure having a quench fluid therein;

a cooler vessel;

a quench fluid line extending from the quench fluid supply structure through the cooler vessel, wherein the quench fluid maintained in a liquid state through an entirety of the quench fluid line;

a quench control valve disposed downstream of the cooler vessel along the quench fluid line to control a flow rate of the quench fluid routed therein; and a refrigerant suction drum located downstream of the quench control valve and operable to receive at least a portion of the quench fluid from the quench fluid line, the refrigerant suction drum in fluid communication with at least one component of the compressor for cooling the at least one component, wherein downstream of the quench control valve is a vertical portion that includes a mixer, the quench fluid line extending downstream of the mixer for at least a length of ten times a diameter of the quench fluid line terminating at a tie-in location to the refrigerant suction drum.

18. The quench system of claim 17, wherein a distance of the quench fluid line between the tie-in location and the refrigerant suction drum is at least five times the diameter of the quench fluid line.

19. The quench system of claim 17, wherein the refrigerant suction drum feeds a plurality of quench injection nozzles.

* * * * *